US005376986A

United States Patent [19]

Long

[11] Patent Number: 5,376,986

[45] Date of Patent: Dec. 27, 1994

[54] LEADER CARD ATTACHABLE TO A PHOTOGRAPHIC FILMSTRIP HAVING A LEAD END WITH A PAIR OF APERTURES

[75] Inventor: Francis C. Long, Rochester, N.Y.

[73] Assignee: Eastman Kodak Company, Rochester, N.Y.

[21] Appl. No.: 80,793

[22] Filed: Jun. 22, 1993

[51] Int. Cl.[5] ..... G03D 3/08

[52] U.S. Cl. ..... 354/321; 354/345

[58] Field of Search ..... 354/297, 319, 320, 321, 354/322, 345; 226/91, 92; 242/55.1, 76, 180, 186, 195; 352/235

[56] References Cited

U.S. PATENT DOCUMENTS

| | | | |
|---|---|---|---|
| 3,462,054 | 8/1969 | Foor | 226/91 |
| 3,724,776 | 4/1973 | McKee | 242/195 |
| 4,065,042 | 12/1977 | Zielinski | 226/92 |
| 4,110,774 | 8/1978 | Krehbiel et al. | 354/345 |
| 4,140,383 | 2/1979 | Schmidt | 354/316 |
| 4,239,367 | 12/1980 | Hope et al. | 354/319 |
| 4,662,554 | 5/1987 | Yamazaki et al. | 226/170 |
| 5,015,089 | 5/1991 | Radov | 352/235 |

FOREIGN PATENT DOCUMENTS 859741 9/1990 Japan .

*Primary Examiner*—D. Rutledge
*Attorney, Agent, or Firm*—David A. Howley

[57] ABSTRACT

A leader card is provided which is attachable to a photographic filmstrip having a lead end with a pair of apertures. The leader card includes an essentially flat piece of material having an aperture and a slit extending from the aperture to an edge of the flat piece of material to define a pair of flaps of the flat piece of material between its aperture, slit and edge. The flaps are sized to extend through a pair of apertures in a lead end of a filmstrip to secure the flat piece of material and the lead end together.

10 Claims, 5 Drawing Sheets

LEADER CARD ATTACHABLE TO A PHOTOGRAPHIC FILMSTRIP HAVING A LEAD END WITH A PAIR OF APERTURES

FIELD OF THE INVENTION

This invention relates generally to the field of photography, and more particularly to a leader card used to pull photographic film through a photofinishing apparatus. Specifically, the invention relates to a leader card attachable to a photographic filmstrip having a lead end with a pair of apertures.

BACKGROUND OF THE INVENTION

In order to develop exposed photographic film, it is necessary to contact the film with a number of solutions including a developer, fix and wash solution. One way to contact the film with these solutions is to attach a leader card to the lead end of one or more filmstrips and pull or tow the leader card through a film processor which contains the various solutions. When the leader card is pulled through the film processor, the film is likewise pulled through the film processor behind the leader card. The film is pulled through tanks containing the various developing solutions. After the film has been contacted by the developing solutions, the film is dried and is caused to exit the film processor.

Typically, the film exits the film processor in long strips, with the leader card still attached, and falls into a receptacle. An operator periodically takes the strips of film from the receptacle, with the leader card attached, and manually removes the filmstrips from the leader card. The film can then be inserted into a photographic printer to make prints of the images stored on the developed film.

PROBLEMS TO BE SOLVED BY THE INVENTION

A problem with letting the developed film and leader card fall into a receptacle is that the film can become damaged when it lands in the receptacle and/or when it is contacted by other film in the receptacle. The film can become further damaged during transport by the operator from the film processor to the photographic printer. For example, the operator may impart fingerprints to the film while carrying the film to the printer.

One way to greatly reduce the chance of the film becoming damaged after it exits the film processor is to feed the film into an intermediate storage cartridge or the original film cartridge as the film exits the processor. As such, the film cannot be contacted by the receptacle, other film or an operators hands. Additionally, placing the film back in the film cartridge facilitates making prints from the film and/or returning the film to the customer. In order to efficiently insert the film into the intermediate cartridge, it is preferable to automatically remove the leader card from the lead end of the film after the lead end has exited the film processor. Present leader cards do not facilitate removal of the leader card from the film in a simple and automatic manner such that the film is not damaged.

SUMMARY OF THE INVENTION

According to one aspect of the invention, a leader card is provided which is attachable to a photographic filmstrip having a lead end with a pair of apertures. The leader card includes an essentially flat piece of material having an aperture and a slit extending from the aperture to an edge of the flat piece of material to define a pair of flaps of the flat piece of material between its aperture, slit and edge. The flaps are sized to extend through a pair of apertures in a lead end of a filmstrip to secure the flat piece of material and the lead end together.

ADVANTAGEOUS EFFECTS OF THE INVENTION

The present invention allows a leader card to be removed from a photographic filmstrip in a simple and automatic manner such that there is no damage to the filmstrip. As a result, the filmstrip can be automatically inserted into an intermediate cartridge upon exiting a photofinishing apparatus such as a film processor. By storing the film in an intermediate cartridge, damage to the film is avoided after the film exits the film processor.

DETAILED DESCRIPTION OF THE INVENTION

Figure 1:
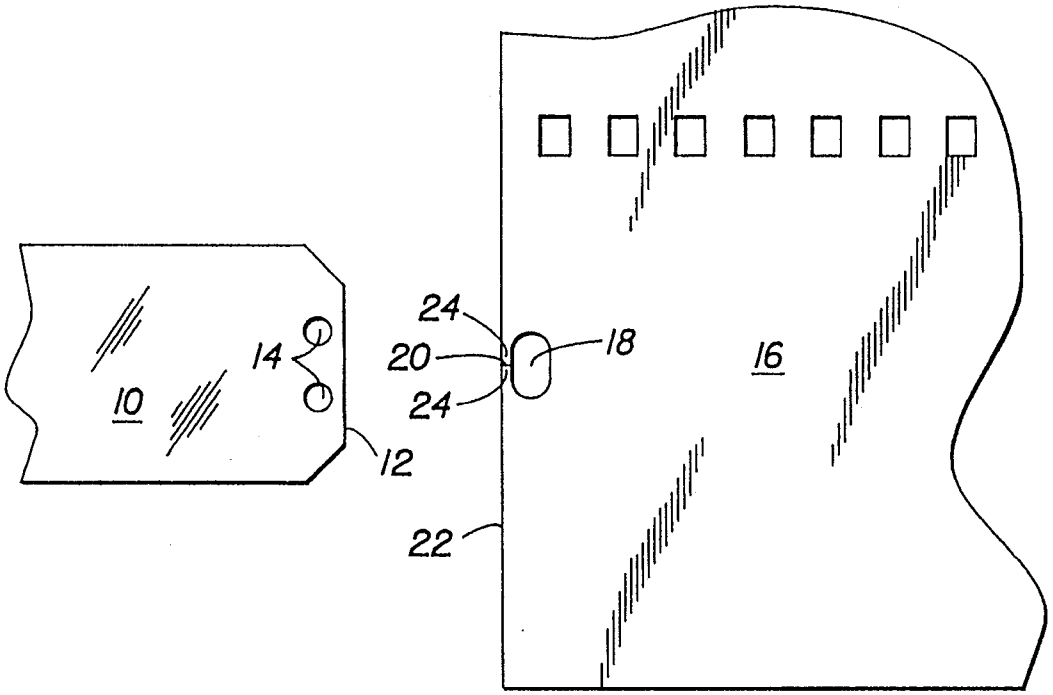
FIG. 1 is a top view displaying a filmstrip and leader card separated from each other.

Referring now to the drawings, FIG. 1 shows a photographic filmstrip 10 having a lead end 12. Lead end 12 has a pair of apertures 14. A leader card 16, made of an essentially flat piece of material such as plastic or mylar, includes an aperture 18. A slit 20 extends from the aperture to an edge 22 of the leader card. Aperture 18, slit 20 and edge 22 define a pair of flaps 24.

Figure 2:
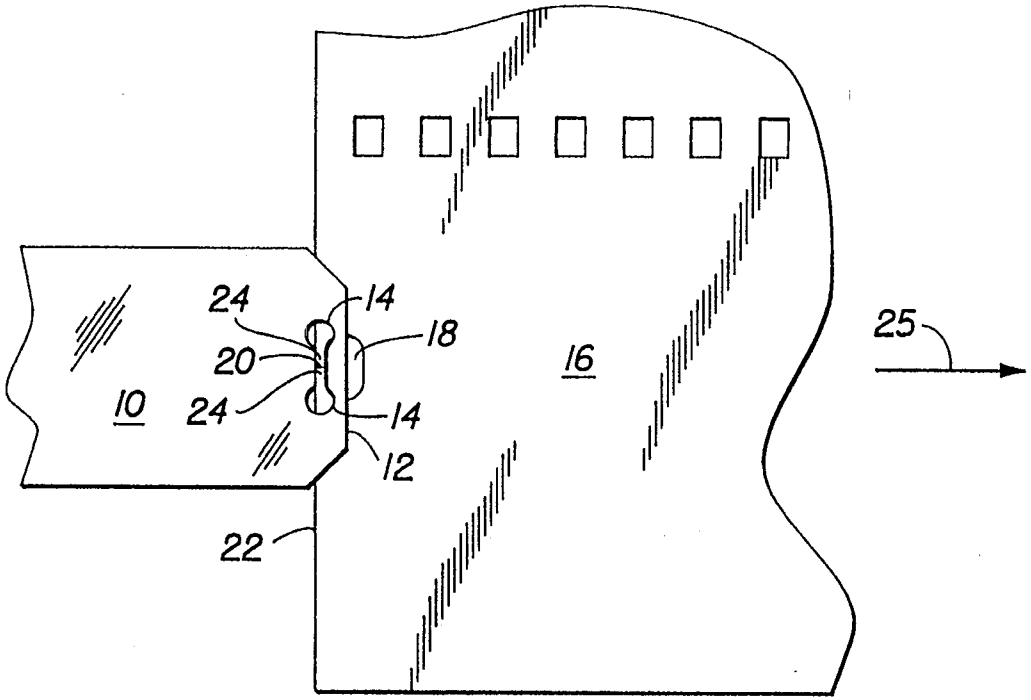
FIG. 2 is a top view of the filmstrip and leader card of FIG. 1 joined together

Turning now to FIG. 2, leader card 16 and filmstrip 10 have been joined together. The leader card and filmstrip are joined together by inserting flaps 24 through apertures 14 in the filmstrip. Apertures 14, aperture 18 and slit 20 are sized and located such that flaps 24 will fit through apertures 14 to secure the leader card to the lead end of the filmstrip. When the leader card is pulled or towed in a direction indicated by arrow 25, filmstrip 10 will likewise be towed in a like direction without becoming separated from the leader card. Preferably apertures 14 have a length in the direction of arrow 25 which is at least as long as a length of flaps 24 in the direction of arrow 25.

Figure 3:
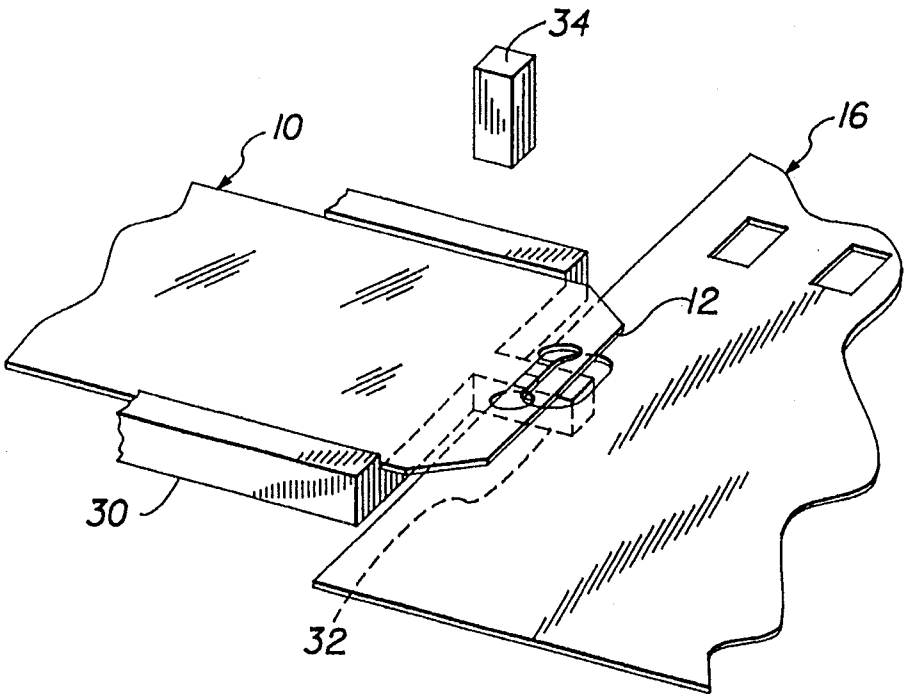
FIG. 3 is a perspective view of the filmstrip and leader card of FIG. 2 supported on a filmstrip track and support member.
Figure 4A:
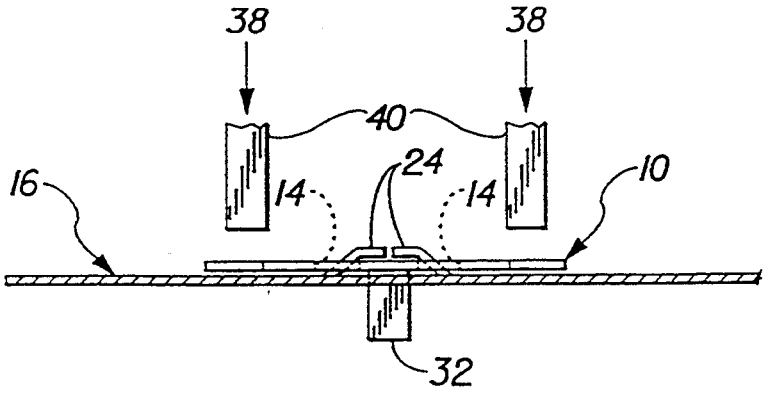
FIGS. 4A–C are front views representing the steps involved in removing the leader card from the filmstrip.
Figure 4B:
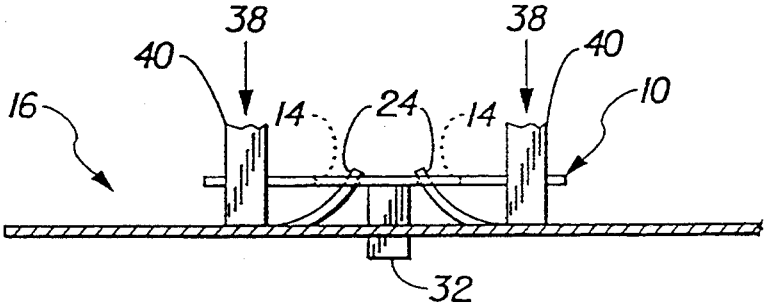
Figure 4C:
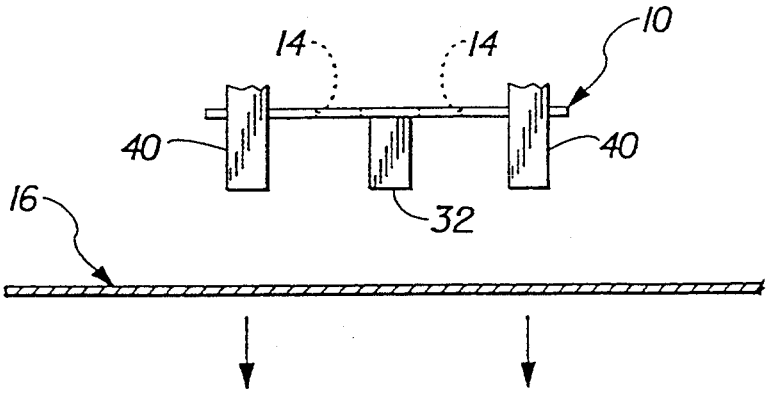
Figure 5A:
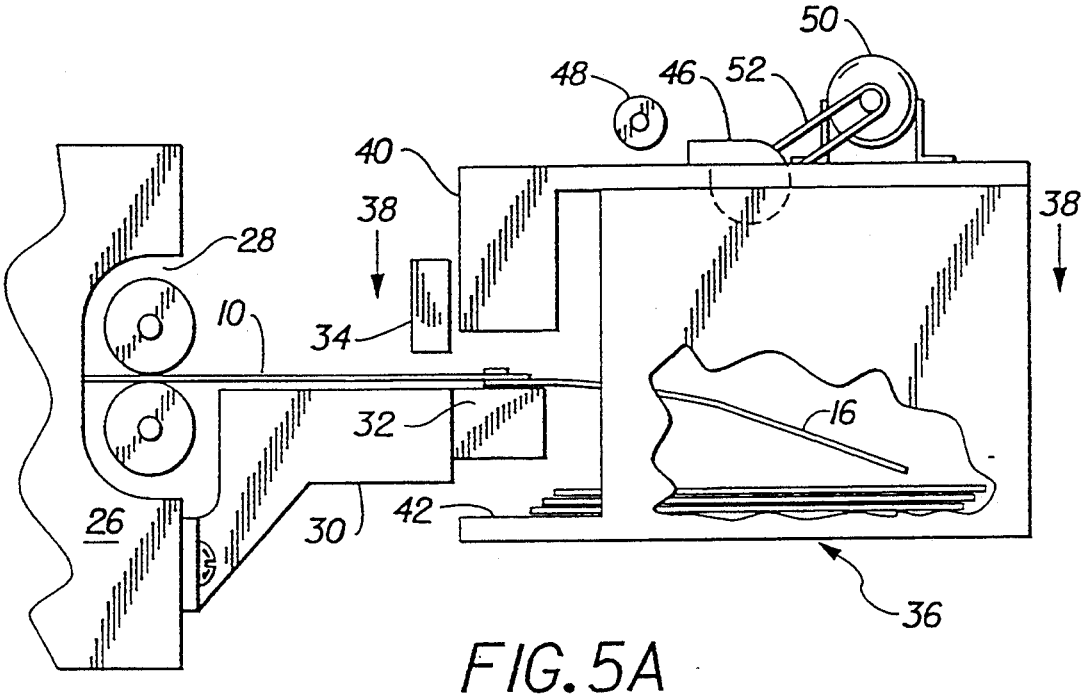
FIGS. 5A–B are side views schematically representing a device for removing a leader card from a filmstrip.
Figure 5B:
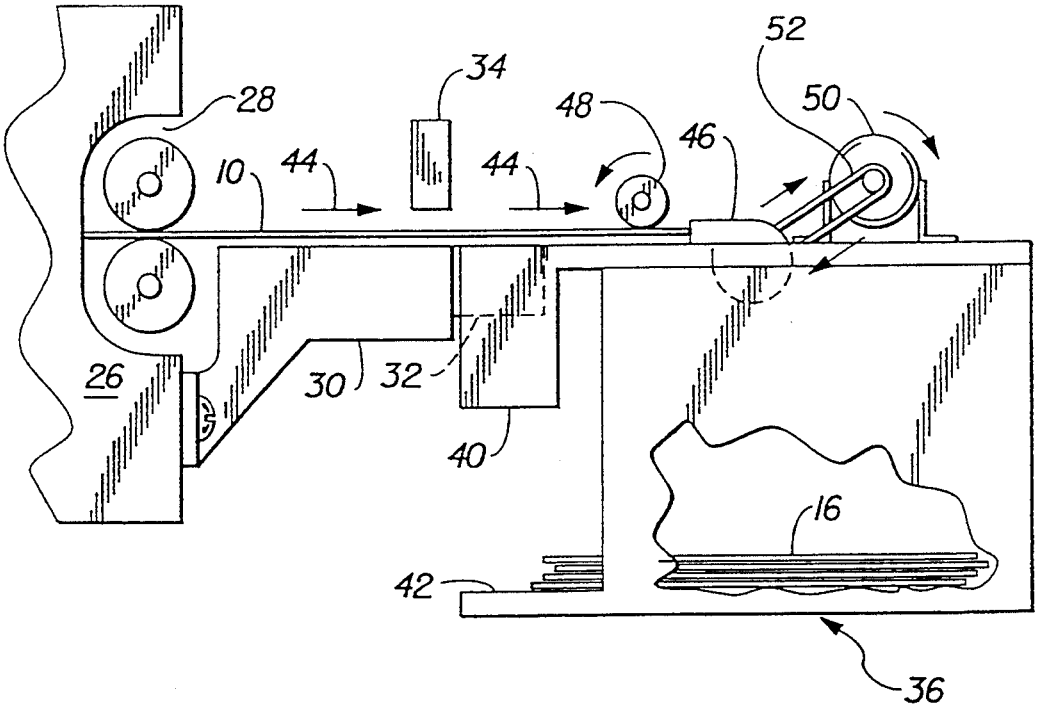

Referring to FIGS. 3–5, as leader card 16 and filmstrip 10 exit a film processor 26 at a film processor exit 28, the filmstrip and leader card are supported on a filmstrip track 30. At one end of the filmstrip track is a support member 32. A sensor 34, which may include, for example, a light emitting diode and a charge coupled device, detects when edge 22 of leader card 16 has reached the sensor. When edge 22 has reached sensor 34, lead end 12 of filmstrip 10 is supported on support member 32 between apertures 14. Movement of filmstrip 10 is momentarily halted.

At this point, a housing 36 is rapidly moved in the direction of arrows 38. Housing 36 supports a pair of stripper fingers 40. As the housing is moved, stripper fingers 40 are moved and contact leader card 16, preferably adjacent flaps 24. Stripper fingers 40 push leader card 16 in the direction of arrows 38 which causes flaps 24 to be withdrawn from apertures 14. When housing 36 has reached the limit of its movement, leader card 16 has been detached from filmstrip 10 and the leader card falls onto a storage shelf 42.

The filmstrip is again moved in the direction of arrows 44 and guided into an intermediate cartridge 46 by a guide roller 48. Because the filmstrip has been developed, it is no longer light sensitive. Therefore there need be no plush or other light-lock at the entrance to the intermediate cartridge. Preferably, the entrance to cartridge 46 is relatively large compared to the thickness and width of the filmstrip to facilitate inserting the lead end of the filmstrip into the intermediate cartridge. A spool drive motor 50 is actuated which rotates a pulley 52. The pulley is connected to and rotates a spool located in the intermediate cartridge. Rotation of the spool facilitates insertion of filmstrip 10 into intermediate cartridge 46.

PARTS LIST FOR FIGS, 1–5

10 Photographic Filmstrip
12 Lead End
14 Apertures
16 Leader Card
18 Aperture
20 Slit
22 Edge
24 Flaps
25 Arrow
26 Film Processor
28 Processor Exit
30 Filmstrip Track
32 Support Member
34 Sensor
36 Housing
38 Arrows
40 Stripper Fingers
42 Storage Shelf
44 Arrows
46 Intermediate Cartridge
48 Guide Roller
50 Spool Drive Motor
52 Pulley

What is claimed is:

1. Apparatus for automatically removing a leader card from a photographic filmstrip, wherein the leader card has an aperture and a slit extending from the aperture to an edge of the leader card to define a pair of flaps of the leader card which are sized to extend through a pair of apertures in a lead end of the photographic filmstrip, said apparatus comprising:

means for supporting said photographic filmstrip; and means for providing relative movement between said lead end of said photographic filmstrip and said leader card such that said lead end and said leader card are moved away from each other in a direction essentially perpendicular to a plane which includes said lead end and said leader card to remove said flaps from said pair of apertures, thereby separating said lead end and said leader card.

2. The apparatus of claim 1, wherein said providing means includes:

a surface for supporting the lead end of said filmstrip between said pair of apertures; and means for pushing said leader card in a direction essentially perpendicular to a plane which includes said leader card such that said flaps are withdrawn from said pair of apertures causing said leader card to be removed from said filmstrip.

3. The apparatus of claim 2, wherein said pushing means is effective to push said leader card adjacent both of said flaps.

4. The apparatus of claim 1, further including:

means for automatically inserting said photographic filmstrip into a film cartridge.

5. The apparatus of claim 1, wherein said pair of apertures in said filmstrip each have a length at least as long as a length of said flaps.

6. A combination of a leader card and a lead end of a photographic filmstrip for use in a photofinishing apparatus, comprising:

a leader card having an aperture and a slit extending from the aperture to an edge of the leader card to define a pair of flaps of the leader card; and a lead end of a photographic filmstrip, said lead end having a pair of apertures, said pair of flaps being sized to extend through said pair of apertures to secure the leader card and lead end of the filmstrip together.

7. The combination of claim 6, wherein said pair of apertures in said lead end of said filmstrip each have a length at least as long as a length of said pair of flaps.

8. A leader card attachable to a photographic filmstrip having a lead end with a pair of apertures, the leader card comprising:

an essentially flat piece of material having an aperture and a slit extending from the aperture to an edge of the flat piece of material to define a pair of flaps of the flat piece of material which are sized to extend through a pair of apertures in a lead end of a filmstrip to secure the flat piece of material and the lead end together.

9. The leader card of claim 8, wherein said flat piece of material is made of plastic.

10. The leader card of claim 8, wherein said aperture in said flat piece of material has a width at least as wide as a width of a portion of a lead end of a photographic filmstrip which separates a pair of apertures in the lead end of the filmstrip.

* * * * *